United States Patent [19]

Nordschild et al.

[11] 4,335,003

[45] Jun. 15, 1982

[54] PREPARATION AGENT FOR THE PRODUCTION OF SYNTHETIC FILAMENTS

[75] Inventors: Christlieb Nordschild, Stuttgart; Paul Rathfelder, Boeblingen; Horst Rieckert, Calw; Dieter Wolber, Magstadt, all of Fed. Rep. of Germany

[73] Assignee: Schill & Seilacher GmbH & Co., Boeblingen, Fed. Rep. of Germany

[21] Appl. No.: 165,569

[22] Filed: Jul. 3, 1980

[30] Foreign Application Priority Data

May 5, 1979 [DE] Fed. Rep. of Germany ..... 2927170

[51] Int. Cl.[3] ..... D06M 13/18; C10M 3/22; D06M 15/08

[52] U.S. Cl. ..... 252/8.9; 252/52 A; 427/393.1; 428/361; 568/618; 568/624

[58] Field of Search ..... 252/8.9, 52 A; 427/393.1; 428/361; 568/618, 624

[56] References Cited

U.S. PATENT DOCUMENTS

| | | | |
|---|---|---|---|
| 2,425,755 | 8/1947 | Roberts et al. | 252/52 A |
| 3,110,736 | 11/1963 | De Groote et al. | 252/8.9 |
| 3,110,737 | 11/1963 | De Groote et al. | 252/8.9 |
| 3,834,935 | 9/1974 | Symm et al. | 428/361 |
| 3,940,544 | 2/1976 | Marshall et al. | 252/8.9 |
| 3,966,625 | 6/1976 | Tanizaki et al. | 252/52 A |
| 3,997,450 | 12/1976 | Steinmiller | 252/8.9 |
| 4,094,797 | 6/1978 | Newkirk et al. | 252/8.9 |
| 4,111,819 | 5/1978 | Muijaitti | 252/52 A |
| 4,118,326 | 10/1978 | Login | 252/8.9 |
| 4,134,841 | 1/1979 | Park et al. | 252/8.9 |
| 4,198,464 | 4/1980 | Login et al. | 428/361 |
| 4,199,647 | 4/1980 | Newkirk et al. | 252/8.9 |
| 4,245,004 | 1/1981 | Login et al. | 427/393.1 |

FOREIGN PATENT DOCUMENTS

| | | | |
|---|---|---|---|
| 525843 | 6/1956 | Canada | 568/618 |
| 1174290 | 7/1964 | Fed. Rep. of Germany . | |
| 2162672 | 6/1973 | Fed. Rep. of Germany . | |
| 2250937 | 4/1974 | Fed. Rep. of Germany | 568/618 |
| 2502155 | 7/1975 | Fed. Rep. of Germany . | |
| 2403283 | 8/1975 | Fed. Rep. of Germany . | |

OTHER PUBLICATIONS

Teijin, Ltd. Textile Abstract of JA 49 072417.
Levine Textile Abstract of BE 601 280.

*Primary Examiner*—Maria Parrish Tungol
*Attorney, Agent, or Firm*—Schwartz, Jeffery, Schwaab, Mack, Blumenthal & Koch

[57] ABSTRACT

Disclosed are a process for the preparation of synthetic filaments or fibers and a composition for use as an auxiliary agent in the production of such fibers and filaments. The composition comprises a butylene oxide adduct of a fatty alcohol oxyethylate having the formula $$R—O—(C_2H_4O)_n—(C_4H_8O)_mH$$

wherein
$R = C_8–C_{26}$,
$n = 1–20$, and
$m = 1–5$ and preferably at least one additional chemical treating agent for the synthetic fibers and filaments. The process includes the step of applying this composition to a fiber or filament.

8 Claims, No Drawings

PREPARATION AGENT FOR THE PRODUCTION OF SYNTHETIC FILAMENTS

BACKGROUND OF THE INVENTION

The preparation and processing of synthetic fibers and filaments require the use of auxiliary synthetic fiber agents. Their function is to provide the fibers and filaments with the properties necessary for their preparation and further processing, such as for example, smoothness, anti-static properties, fiber adhesion, etc. Since the requirements concerning auxiliary chemical agents for fibers are highly varied, normally the use of a single chemical substance is not sufficient and special mixtures must be applied. Quantitatively, the largest proportion normally consists of lubricants.

In the past, usually mineral oils of various compositions and viscosities or ester oils of different chemical structures, or mixtures of both, were applied as lubricants. Their principal advantage resides in the fact that they are capable of providing the synthetic fibers with any desired or required smoothness, when used in correct proportions. Viscosity is a highly important criterion of selection for this purpose. In general, the lower the viscosity, the lower the friction between the fiber and a friction body. Due to their low boiling points or boiling ranges, they exhibit the disadvantages of high volatility, poor adhesion to fibers and low heat resistance. Because of the high volatility and poor fiber adhesion, the fiber is partially deprived of the protective action of the spin preparation. This may lead to mechanically caused damage, and furthermore, deposits are formed in or on the heated parts of the processing machinery, for example, on heated harnesses, heating plates and hot pins of draw frames or draw-twisters or in the convection or contact heaters of texturing machines, etc. Because of their low heat resistance, these deposits are decomposed easily and rapidly. The liquid or tar-like or solid decomposition products are capable of strongly hindering the manufacturing process or even of rendering it inoperable. Less volatile, heat resistant products normally have higher viscosities and thus have higher friction coefficients, which makes them unsuitable as lubricants.

The above is true, with certain qualifications, for the other components of spinning preparations.

In the past, when relatively low processing velocities and lower processing temperatures were used, these problems were not as severe, and means were found to handle them. In spite of this, as early as in the 1960's, the need for less volatile and heat resistant preparations became apparent.

The very rapid technical progress of the last 10 years with the development of rapid spinning and stretch-spinning processes for filaments and staple fibers, of stretch-spinning texturing processes, of BCF yarns (bulked continuous filaments) and stretch texturing processes of filaments at very high velocities, rendered the development of entirely new preparations necessary. The principal requirements were: heat resistance, low volatility, good anti-static effectiveness, good wetting ability, adequate fiber adhesion ability, compatibility with other auxiliary agents, such as for example, spooling oil or fats, and good washability.

These requirements made the use of new, synthetic substances necessary. Mineral oils and most of the ester oils were eliminated because of their low boiling points, the resulting volatility and their low heat resistance.

The problem therefore consisted of finding lubricants which would provide synthetic fibers and filaments with moderate or low frictional properties between fibers and a friction body and simultaneously with good fiber adhesion, while having good resistance to heat and adhesion to the fibers, so that deposits in heaters or on heating plates, harnesses, etc. are prevented or restricted to a minimum.

Ethoxylated fatty alcohols or fatty acids have been known for a long time as lubricants, which when applied to fibers, provide intermediate to low friction between fibers and friction bodies, but in general do not satisfy the requirements concerning heat resistance and volatility.

A new development consists of the group of poly(ethylene)-propylene-oxide mixed alkoxylates, which represent good lubricating components even at intermediate viscosities of the products and cause no deposits on machine parts at working temperatures around 250° C., due to their depolymerization without residues at such temperatures . Mixed oxyalkylates based, for example, on butanol or pentaerythritol are known for this purpose.

U.S. Pat. No. 3,997,450 describes the use of alkyl-terminated oxyethylates as a preparation agent, for example, the methyl ether of a coconut fatty alcohol converted with ethylene oxide. In German Pat. No. 15 20 647 are described polyethers terminated by olefins, for example, the tertiary butyl ethers of alcohols. They may be obtained by means of reacting the corresponding alcohols with isobutylene. It is known from these compounds to block open alcoholic hydroxyl groups in the terminal positions.

SUMMARY OF THE INVENTION

It is therefore an object of the present invention to provide an improved auxiliary agent for use in the production of synthetic fibers and filaments.

It is also an object of the invention to provide an improved process for the production of synthetic fibers and filaments, wherein the improved auxiliary agent is utilized.

In accomplishing the foregoing objects, there has been provided in accordance with one aspect of the present invention a composition for use as an auxiliary agent in the production of synthetic fibers and filaments, comprising a butylene oxide adduct of a fatty alcohol oxyethylate having the formula $$R—O—(C_2H_4O)_n—(C_4H_8O)_mH$$

wherein $R = C_8–C_{26}$, $n = 1–20$, and $m = 1–5$ and at least one additional chemical treating agent for the synthetic fibers and filaments.

In accordance with another aspect of the present invention there has been provided a process for the preparation of a synthetic filament or fiber, comprising the steps of forming a strand of a synthetic fiber-forming material and applying to the strand an auxiliary agent comprising a butylene oxide adduct of a fatty alcohol oxyethylate having the formula set forth above.

Other objects, features and advantages of the present invention will become apparent from the detailed description of preferred embodiments which follows.

DETAILED DESCRIPTION OF PREFERRED EMBODIMENTS

It has now been found surprisingly that the use of butylene oxide adducts of fatty alcohol oxyethylates, having the general formula $$R-O-(C_2H_4O)_n-(C_4H_8O)_mH$$

wherein $R=C_8-C_{26}$
$n=1-20$
$m=1-5$ as a preparation or a component of a preparation for the production of synthetic filaments offers particular advantages.

Products wherein the length of the chain of the fatty alcohol oxyethylate is $R=C_8-C_{26}$ and which may be based on synthetic or natural alcohols and wherein the degree n of ethoxylation of the fatty alcohol is between 1 and 20 and the degree m of butoxylation is between 1 and 5, are particularly suitable for use according to the invention.

The butylene oxide adducts of fatty alcohol oxyethylates claimed are suitable for use according to the invention alone or in a mixture, wherein a combination with fatty alcohol oxyethylates, fatty acid oxyethylates and poly-(ethylene)-propylene oxide mixed alkoxylates may be effected.

While ethoxylated fatty alcohols or fatty acids, poly-(ethylene)-propylene oxide mixed alkoxylates or alkyl-terminated oxyethylates are described in the literature as preparation agents or components thereof, no indication of the butylene oxide adducts of fatty alcohol oxyethylates are found. Compared with the industrially expensive production of, for example, alkyl-terminated fatty alcohol oxyethylates in several stages, the easy and economical accessability of the presently claimed compounds by means of the addition of butylene oxide to fatty alcohol oxyethylates should be emphasized.

The butylene oxide adducts of fatty alcohol oxyethylates claimed are characterized by excellent wetting and spreading properties and good fiber adhesion properties. During heat treatment, the compounds exhibit a very good resistance to heat; they depolymerize without residues and thus cause minimum or no deposits on the processing machinery. In contrast to the above-mentioned compounds used heretofore as preparation agents or components thereof, the butylene oxide adducts of fatty alcohol oxyethylates claimed make it possible to produce yarns of improved quality, with minimal contamination of the processing machinery, thus providing substantially longer running times.

Due to the excellent wetting ability of the compounds claimed, highly uniform films of the preparation are obtained on the surface of synthetic fibers and filaments, and therefore friction coefficients are constant. This guaranties constant friction properties of the filament guiding elements on stretching frames, the surface of contact heaters or on the twisters of stretch-twisters, twisting and texturing machines, etc. which results in very good and uniform yarn qualities. Even during extended storage periods of, for example, POY (preoriented yarn) spinning reels or stretching cops, the friction coefficients and thus the frictional behavior remain constant. This signifies that the preparation remains unchanged on the surface of the fibers and filaments and does not cause changes in the friction coefficients by means of aging or migration effects, thus leaving the processing properties unaltered. This is in contrast to the behavior of numerous spinning preparations.

In mixtures with different heat resistant emulsifiers and anti-static agents, selected products may be prepared with friction coefficients which are independent or dependent within certain limits on the layer of the preparation applied. Both of these have certain advantages. When friction coefficients are dependent on the application, it is possible to adapt frictional conditions to the requirements of the operation. This is of particular advantage when different titers with different matting degrees are to be produced. It is known that this requires preparations differing in their frictional behavior. The independence of the friction coefficient from the deposit on the fiber is always of advantage when such deposits fluctuate strongly for any reason whatsoever. Normally, this affects the frictional properties and thus the tension of the filament, and this may cause problems in further processing. In the case of constant frictional conditions, in spite of variations in the deposits of the preparation, processing conditions remain constant thus guaranteeing constant yarn qualities.

The preparations may be applied either as pure oils or from aqueous solutions or emulsions. Organic solvents may also be considered. The mode of application depends on operational conditions. Applications are possible by means of rotating disks, immersion or spraying, or by the use of metering pumps by way of injector filament guides. With identical amounts of the preparation applied, its properties are not affected by the mode of application.

The contamination behavior was tested under the following conditions: the products to be tested were applied to freshly spun polyester filaments by means of preparation metering pumps through injector filament guides, from aqueous liquors, with a drawing velocity of 3,500 m/min. The spinning titer was about 265/34 dtex. This type of preparation application provides, in the case of identical liquor concentrations, an approximately uniform deposit of the preparation. The polyester yarns produced in this manner were stretch-extruded on a HEBERLEIN Type FZ 25 texturing machine with a velocity of 100 m/min, with magnetic spindles and a stretching ratio of 1:1.59. The texturing period was 48 hours.

In order to determine the amount of residues deposited, the metal tubes of the texturing heater were replaced by glass tubes; these were accurately weighed prior to the test. Additionally, special glass vessels were installed underneath the individual filament outlet orifices of the texturing heater, in order to collect and quantitatively determine any components of the preparation possibly dripping out of the heating tubes. By weighing the glass tubes and the receiver cuplets, the amounts collected may be determined quantitatively and qualitatively. The optical evaluation of the glass tube provides further information concerning the distribution of residue in the heater.

The frictional properties of the products to be examined may be determined with the aid of commercially available measuring instruments at different measuring velocities on the running filament. Polyester yarns preoriented on Sennel spinners (3,500 m/min) were used as the carrier material (spin titer 255/34 dtex); they were coated with the products to be examined by the abovementioned method. The F-meter of the ROTHSCHILD CO. was used as the measuring instrument. To determine the friction between the filament and the friction body, a dull polished chromium roll with a diameter of 20 mm was used. The angle of contact was 180°. To determine the friction between filaments, a piece of the yarn to be examined was stressed over a length of 60 mm with an exactly defined prestress. The filament to be moved was wound four times around this filament, producing an angle of contact of $3\times360°+1\times180°=1260°$. The measurements were performed and evaluated according to the method of Dr. LANGE of HOECHST AKTIENGESELLSCHAFT.

The friction coefficient is usually given in $\mu$-values and is calculated by the EYTELWEIN equation for rope friction:

$$S_2/S_1=e^{\mu\cdot\alpha} \text{ or } \mu=(\ln S_2-\ln S_1)/\alpha$$

wherein $S_1$=the force acting before the friction body $S_2$=the force existing after the friction body $\alpha$=angle of contact The friction coefficient $\mu$ is a dimensionless value.

EXAMPLE 1

This experiment illustrates by way of example of three different preparation mixtures that deposits may be strongly reduced by the use of the butylene oxide adducts of fatty alcohol ethoxylates of the invention. The following mixtures of products were applied by the above-mentioned method during the rapid spinning process to the polyester yarn, which was then stretch-extruded on a texturing machine FZ 25 of the HEBERLEIN CO. for 43 hours with magnetic spindles.

COMPARATIVE PREPARATIONS

I: 20 parts mineral oil (5° E)

40 parts isotridecyl stearate 40 parts of a mixture of fatty acid ethoxylate, fatty alcohol ethoxylate and nonylphenolethoxylate II: 65 parts $C_{10}$–$C_{14}$ fatty alcohol oxyethylate with 6–7 mole ethylene oxide 35 parts poly-(ethylene)-propyleneoxide mixed alkoxylates

PREPARATION ACCORDING TO THE INVENTION

III: 65 parts butylene oxide adduct (1–2 moles) on $C_{10}$–$C_{14}$ fatty alcohol oxyethylate with 6–7 moles ethylene oxide 35 parts poly-(ethylene)-propylene oxide mixed alkoxylates Results are presented in Table 1.

TABLE 1

| MIXTURE | | I | II | III |
|---|---|---|---|---|
| Running time | Hours | 48 | 48 | 48 |
| Preparation deposit prior to texturing | (%) | 0.42 | 0.45 | 0.40 |
| Preparation deposit after texturing | (%) | 0.20 | 0.37 | 0.30 |
| Deposits in glass tubes | (g) | 4.165 | 1.816 | 0.086 |
| Deposits in receiving cuplets | (g) | 2.731 | 0.568 | 0.028 |

Table 1 shows that the loss of preparation occurring during texturing is the highest with the use of preparations based on mineral oil and ester oil (I) as expected, and substantially less and approximately comparable with the structurally similar preparations II and III. The improvement obtainable with the use of the butylene oxide adducts of fatty alcohol oxyethylates according to the invention is clearly visible by the comparative residue of preparations tested under identical conditions. While Preparation I based on mineral and ester oil exhibits the usual strong deposits, the preparation according to the invention (III) shows a particularly favorable thermal behavior, because in spite of the approximately equal losses of preparation in the case of II and III, the preparation of the invention shows only about 5% of the contamination caused by II in the glass tube and receiver cuplets (contamination by II was set to equal 100%). The mineral-ester oil preparation shows in this treatment unacceptably high values, as seen in Table 1.

EXAMPLE 2

Under the effect of a heat treatment, for example, in the heaters of texturing machines and of the high yarn rotation values, the friction coefficient may increase strongly as a result of loss of preparation. This leads to an increase in the stress in the yarn, in turn resulting in increased capillary and yarn breakage numbers, and thus in loss of quality. The use of the butylene oxide adducts of the invention strongly reduces this increase.

In order to test the effect of a heat treatment on frictional behavior, the rapidly spun polyester yarns—coated as described hereinabove—were hot stretched on the HEBERLEIN FZ 25 and reeled without texturing, i.e., without passing over spindles. Frictional properties were determined by the measuring method of Dr. LANGE of HOESCHST AKTIENGESELLSCHAFT, using the F meter of the ROTHSCHILD CO.; the deposits of the preparations were determined before and after the heat treatment.

Measurements of friction values to determine the friction of filament to filament, were effected at a filament velocity of 20 m/min and at 150 m/min for filament/metal frictions.

The products I, II and III specified in Example 1 were used.

Results are presented in Table 2.

TABLE 2

| | VALUES PRIOR TO HEAT TREATMENT | | | VALUES AFTER HEAT TREATMENT | | |
|---|---|---|---|---|---|---|
| PRODUCT | FA | F/M | F/F | FA | F/M | F/F |
| I | 0.42 | 0.28 | 0.25 | 0.24 | 0.42 | 0.19 |
| II | 0.45 | 0.38 | 0.32 | 0.39 | 0.43 | 0.29 |
| III | 0.40 | 0.36 | 0.29 | 0.31 | 0.37 | 0.26 |

FA = deposit on filament in %

F/M = filament/metal friction (in $\mu$)

F/F = filament/filament friction (in $\mu$)

As seen in Table 2, in the case of Product I a strong increase in the filament/metal friction and a decrease in the filament/filament friction is found, because of the high losses of preparation. The same trend may be observed with Product II.

Product III also shows a reduction in the filament/filament friction, but the filament/metal friction remains approximately constant, i.e., the stress in the yarn is substantially lower with the use of the preparation according to the invention, as indicated by the reduced number of capillary and filament breakages and the substantially improved yarn quality.

What is claimed is:

1. A composition for use as an auxiliary agent in the production of synthetic fibers and filaments, comprising a butylene oxide adduct of a fatty alcohol oxyethylate having the formula $$R—O—(C_2H_4O)_n—(C_4H_8O)_mH$$

wherein $R=C_8-C_{26}$ $n=1-20$, and $m=1-5$ and at least one additional component of spinning preparations for the synthetic fibers and filaments.

2. A composition as defined in claim 1, wherein said butylene oxide adduct is present in an aqueous phase.

3. A composition as defined by claim 1, wherein said additional component of spinning preparations is selected from a fatty alcohol oxyethylate, a fatty acid oxyethylate or a poly-(ethylene)-propylene oxide mixed alkoxylate.

4. A composition as defined in claim 1, wherein said butylene oxide adduct comprises more than about 50% of said composition.

5. A composition as defined in claim 1, wherein $R=C_{10}-C_{14}$, $n=6-7$ and $m=1-2$.

6. A process for the preparation of a synthetic filament or fiber, comprising the steps of:

forming a strand of a synthetic fiber-forming material; and applying to said strand an auxiliary agent comprising a butylene oxide adduct of a fatty alcohol oxyethylate having the formula $$R—O—(C_2H_4O)_n—(C_4H_8O)_mH$$

wherein $R=C_8-C_{26}$, $n=1-20$, and $m=1-5$.

7. A process as defined in claim 6, wherein said butylene oxide adduct comprises a compound of the formula $$R—O—(C_2H_4O)_n—(C_4H_8O)_mH$$

wherein $R=C_{10}-C_{14}$, $n=6-7$, and $m=1-2$.

8. A process as defined in claim 6, wherein said auxiliary agent further comprises a compound selected from a fatty alcohol oxyethylate, a fatty oxyethylate or a poly-(ethylene)-propylene oxide mixed alkoxylate.

* * * * *